US010947686B2

(12) United States Patent
Kueper

(10) Patent No.: US 10,947,686 B2
(45) Date of Patent: Mar. 16, 2021

(54) SANDWICH CLEARING STRIP

(71) Applicant: Kueper GmbH & Co. KG, Bochum (DE)

(72) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 220 days.

(21) Appl. No.: 15/762,902

(22) PCT Filed: Nov. 30, 2016

(86) PCT No.: PCT/EP2016/079334
§ 371 (c)(1),
(2) Date: Apr. 5, 2018

(87) PCT Pub. No.: WO2017/093352
PCT Pub. Date: Jun. 8, 2017

(65) Prior Publication Data
US 2018/0282960 A1 Oct. 4, 2018

(30) Foreign Application Priority Data
Dec. 1, 2015 (DE) ..... 10 2015 120 823.7

(51) Int. Cl.
*E01H 5/06* (2006.01)

(52) U.S. Cl.
CPC ..... *E01H 5/061* (2013.01)

(58) Field of Classification Search
CPC ..... E01H 5/061; E01H 5/062; E01H 5/065; E01H 5/066; E02F 3/8157
See application file for complete search history.

(56) References Cited

U.S. PATENT DOCUMENTS 4,347,677 A * 9/1982 Kuper ..... E01H 5/061 37/233
6,125,559 A * 10/2000 Mullenhour ..... E01H 5/062 172/816
7,765,726 B2 * 8/2010 Kuper ..... E01H 5/061 37/460
7,905,035 B2 * 3/2011 Thomas ..... E01H 5/061 172/701.3

(Continued)

FOREIGN PATENT DOCUMENTS

DE 33 19 223 A1 7/1984
DE 10 2004 029 165 A1 12/2005
DE 10 2006 021 910 A1 11/2007

(Continued)

OTHER PUBLICATIONS

International Search Report of PCT/EP2016/079334, dated Mar. 20, 2017.

*Primary Examiner* — Jamie L McGowan
(74) *Attorney, Agent, or Firm* — Collard & Roe, P.C.

(57) ABSTRACT

A clearing strip for the clearing blade of a snowplough has, in a sandwich design, a steel baseplate, a steel cover plate and an interposed rubber-elastic layer with at least one embedded hard material element. To better protect the embedded hard material elements from impacts without loss of clearing capability of the cleaning strip during continuous operation, at least one flexible buffer space is provided in the rubber-elastic layer above the hard material elements.

9 Claims, 4 Drawing Sheets

(56) References Cited

U.S. PATENT DOCUMENTS

| | | | | |
|---|---|---|---|---|
| 8,640,365 | B2 * | 2/2014 | Kueper | E01H 5/061 37/233 |
| 2001/0005949 | A1 * | 7/2001 | Amano | B22F 7/06 37/381 |

FOREIGN PATENT DOCUMENTS

| | | | |
|---|---|---|---|
| DE | 10 2009 051 751 | A1 | 5/2011 |
| JP | H01-178606 | A | 7/1989 |

* cited by examiner

SANDWICH CLEARING STRIP

CROSS REFERENCE TO RELATED APPLICATIONS

This application is the National Stage of PCT/EP2016/079334 filed on Nov. 30, 2016, which claims priority under 35 U.S.C. § 119 of German Application No. 10 2015 120 823.7 filed on Dec. 1, 2015, the disclosure of which is incorporated by reference. The international application under PCT article 21(2) was not published in English.

The invention relates to a clearing strip for the clearing blade of a snowplow, which strip has, in a sandwich design, a steel base plate, a steel cover plate, and a rubber-elastic layer that lies between them, having at least one embedded hard-material element.

Such a clearing strip is known, for example, from DE 10 2004 029 165 A1. Clearing strips of this type have proven themselves. They are structured in a sandwich design in order to combine the advantageous properties of steel clearing strips with regard to their aggressive clearing capability and of rubber clearing strips with regard to their wear resistance. The clearing capability and the wear resistance are further increased by the hard-material elements embedded in the rubber-elastic layer. The hard-material elements preferably consist of ceramic or hard-metallic material, and are structured in rod shape or plate shape. The cover plate, the base plate, the rubber layer that lies between them, and the embedded hard-material elements are vulcanized together over a large area and are thereby connected with one another with a material bond. The hard-metallic materials can also be surrounded by an additional steel reinforcement, so as to protect them against impacts and thereby prevent parts of the hard-material elements from being broken out. In this case, the steel reinforcement and the hard-metallic materials are soldered together.

When using this clearing strip, it has been shown that the clearing strip is excellently suited for clearing down to the road surface, which is generally demanded. However, it has also turned out that the embedded hard-material elements can be damaged by impacts perpendicular to the roadway, due to their brittleness. Specifically in the case of aggressive and therefore flat setting angles of the clearing strip, such impacts are relatively frequent. The respective area of use of the clearing strip also has an influence on the frequency and intensity of such impacts. The aforementioned document proposes the steel reinforcement of the hard-material elements as explained above as a solution for this problem. As a result, the clearing strip loses resilience in the region of the interior as the result of the steel reinforcement.

It is the task of the invention to further develop clearing strips of the type stated initially to the effect that the clearing strips and, in particular, their hard-material elements are better protected against impacts perpendicular to the roadway, and as a result, the clearing strips are optimized with regard to their wear resistance and their clearing capability for the respective demands in the area of use, and thereby the useful lifetimes of the clearing strips are increased.

To accomplish this task, the invention proposes, proceeding from a clearing strip of the type stated initially, that at least one resilient buffer space is provided in the rubber-elastic layer, above the hard-material elements.

As a result of this buffer space, the resilience in the interior of the clearing strip is increased in the region above the wear zone. In the case of individual impacts perpendicular to the roadway, the buffer space serves to absorb the material of the rubber-elastic layer that is displaced when the hard-material elements recede. In this manner, a major portion of the energy of the aforementioned impacts is absorbed by the temporary deformation, so that parts of the relatively brittle hard-material elements are prevented from breaking out. In continuous operation, the rubber-elastic layer returns to its original state, and the clearing strip retains its strength and therefore its clearing capability. Experiments have shown that the clearing strip achieves a useful lifetime that is up to 30% longer as the result of this additional resilience.

It is true that a cavity in the rubber body of a clearing strip of a different type is known from DE 10 2009 051 751 A1. There, the rubber body is vulcanized onto a steel attachment neck and reinforced with steel plates at its outer sides, which plates in turn are divided up into individual steel segments. There, it is the purpose of the cavity to protect these individual steel segments against frontal impacts. In contrast to this, the buffer space in the clearing strip according to the invention serves to protect the relatively brittle hard-material elements provided in clearing strips of this type against impacts perpendicular to the roadway.

The resilience in the interior of the clearing strip can be varied by way of the shape, the volume, and the Position of the buffer space. In this manner, the clearing strip can be adapted to the respective demands in the area of use.

Preferably, the buffer space in the rubber-elastic layer runs parallel to the lower edge of the clearing strip and extends over its entire length. As a result, the interior of the clearing strip demonstrates additional resilience over its entire length.

It is practical if the buffer space has the same cross-sectional surface area over its entire length. In this manner, the interior of the clearing strip is given the same resilience over its entire length, and the clearing strip therefore wears away uniformly.

Furthermore, it is advantageous if the cross-sectional surface area of the buffer space is round or at least rounded off at the corners. Experience has shown that rubber-elastic materials tend to form cracks first at corners and/or edges when they are deformed. For this reason, the clearing strip becomes more robust as a whole by means of the round or rounded-off enveloping surface.

In fields of use in which experience has shown that strong and frequent impacts perpendicular to the roadway are to be expected, it is practical if the cross-sectional surface area of the buffer space is elliptical and if the longitudinal axis of the elliptical cross-sectional surface area runs parallel to the lower edge of the clearing strip. By means of this shaping, the clearing strip is more resilient and a large portion of the volume of the buffer space can be used for absorption of the impact energy.

In fields of use in which experience has shown that rather weaker impacts perpendicular to the roadway can be expected, it is practical if the cross-sectional surface area of the buffer space is elliptical and if the longitudinal axis of the elliptical cross-sectional surface area runs perpendicular to the lower edge of the clearing strip. Due to this shaping, the clearing strip is rather firm in the upper region. The elliptical buffer space is merely slightly compressed along its longitudinal axis during impacts. Therefore the clearing strip continues to remain very stable during continuous snow clearing, and can absorb the impacts mentioned above by means of the buffer space.

A further development of the invention provides that the buffer space is filled with a foam rubber or a foam material. In this manner, the resilience of the clearing strip can be adapted to the respective requirements by means of selection of a suitable foam rubber or foam material.

A particularly advantageous embodiment of the buffer space occurs if the buffer space is sheathed by a hose. This has the advantage that the resilience of the clearing strip can be adapted to the respective requirements by way of the properties of the hose, not only with regard to the material but also the hose cross-section. Furthermore, the production process of the clearing strip is simplified, because the hose can be cast into the rubber-elastic layer. Therefore it is possible, under some circumstances, to do without removable cores during vulcanization of the rubber-elastic layer of the clearing strip.

Furthermore, it is advantageous if the buffer space of the clearing strip is a cavity and is open for allowing a cooling medium to be passed through. It has been shown that the clearing strips can become extremely hot due to friction, in particular during clearing down to the road surface. By passing a cooling medium through the cavity, the clearing strip can now be additionally protected against overheating. As the simplest and obvious solution, air in the form of travel air stream is passed through the cavity as a cooling medium. However, it would also be conceivable to use fluids as cooling media.

Embodiments of the clearing strip according to the invention will be explained in greater detail below, using drawings.

Figure 1:
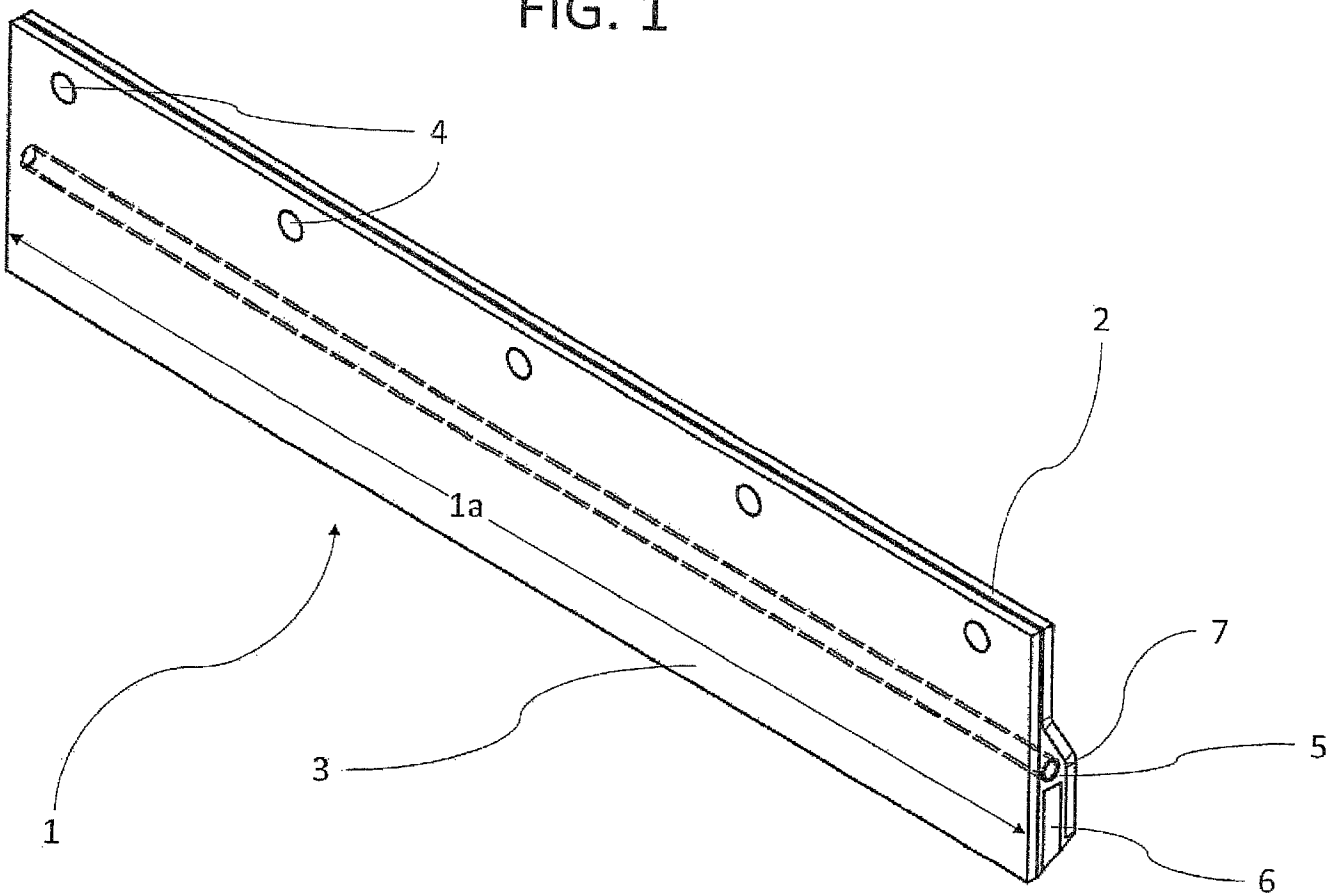
FIG. 1 shows: schematically, a 3D front view of a clearing strip in a first embodiment according to the invention.

In the drawings, a clearing strip is indicated with the reference symbol 1.

In FIG. 1, the clearing strip 1 is shown in a schematic 3D front view in a first embodiment according to the invention. The clearing strip 1 has a steel base plate 2 and a steel cover plate 3. The base plate 2 is offset. In their upper region, they lie flat on top of one another and have bores 4 that lie one on top of the other, in each instance, which bores serve for screw attachment to a clearing blade, not shown here. In other embodiments, not shown here, a connection of clearing strips and snowplow by means of clamping claws or other joining techniques is also possible.

In the lower region, a rubber-elastic layer 5 is vulcanized on between the base plate 2 and the cover plate 3. Hard-material elements 6 are embedded in the rubber-elastic layer 5. The hard-material elements 6 preferably consist of tungsten carbide or corundum. A buffer space 7 in the form of a circular cylinder lies above the hard-material elements 6, which space extends over the entire clearing width 1*a* of the clearing strip 1. This buffer space 7 is introduced into the rubber-elastic layer 5 during the vulcanization process.

Figure 2:
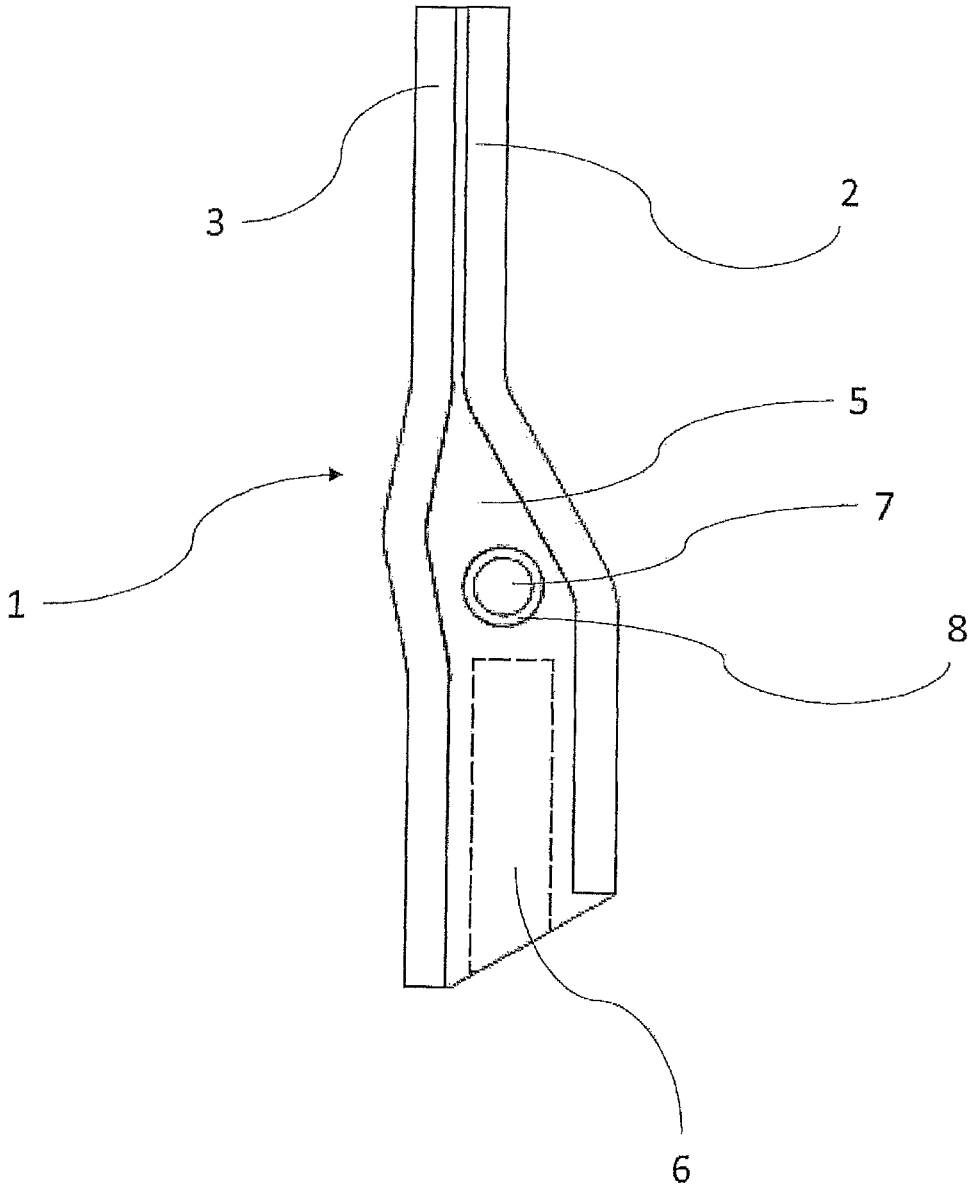
FIG. 2 shows: schematically, a side view of a clearing strip according to the invention in a second embodiment.

The embodiment shown in a side view in FIG. 2 differs from the embodiment from FIG. 1 in that the buffer space 7 is surrounded by a hose 8. This has the advantage that the hose 8 can already be introduced before the vulcanization process, and that no displacement bodies need to be removed after vulcanization. By means of the use of the hose 8, the resilience can be adapted to the requirements in the field of use by way of the selection of the cross-section and of the material of the hose 8.

Figure 3:
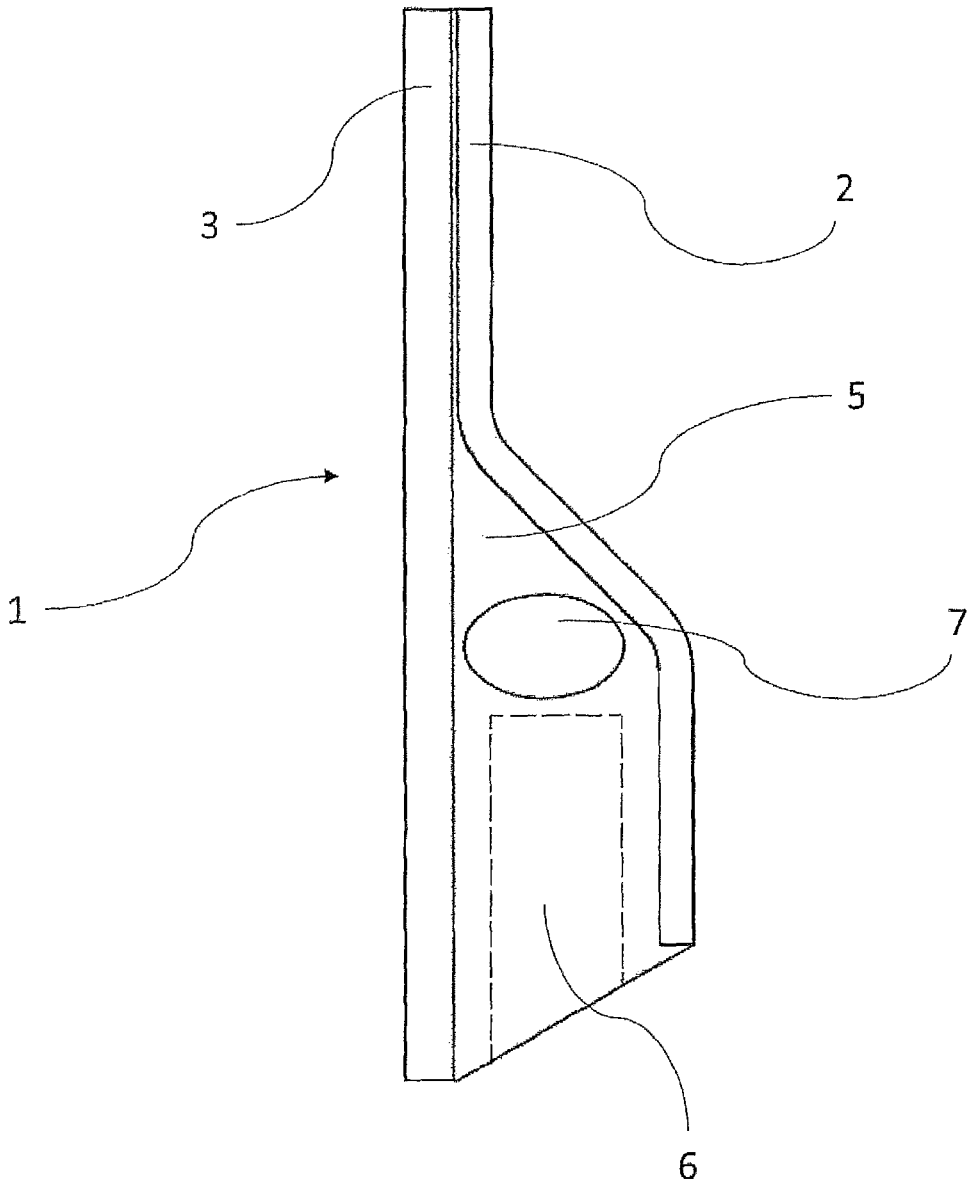
FIG. 3 shows: schematically, a side view of a clearing strip according to the invention in a third embodiment.

FIG. 3 shows a side view of the clearing strip 1 in a third embodiment. Here, the buffer space 7 has an elliptical cross-section. The longitudinal axis of the elliptical buffer space 7 runs parallel to the lower edge of the clearing strip 1. This shape is particularly well suited for absorbing impacts perpendicular to the roadway, since the buffer space 7 is particularly resilient due to this shaping, and a major portion of its volume can serve for energy absorption.

Figure 4:
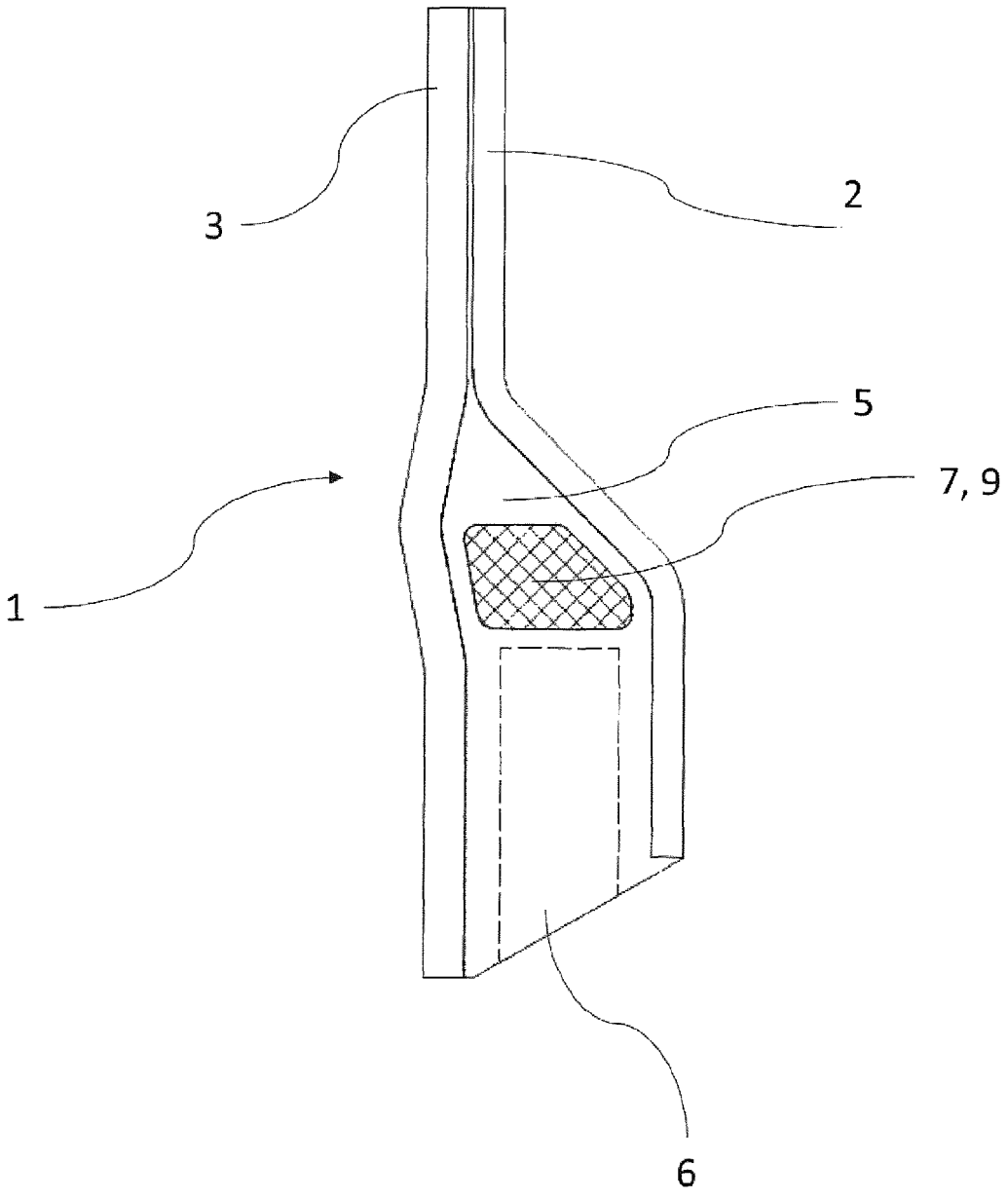
FIG. 4 shows: schematically, a side view of a clearing strip according to the invention in a fourth embodiment.

In FIG. 4, a fourth embodiment of the clearing strip 1 according to the invention is shown in a side view. Here, the buffer space 7 is filled with a foam rubber 9. The resilience of the buffer space 7 can be influenced as a function of the selection of the foam rubber 9 used. By means of this measure, it is possible to easily adapt the clearing strip 1 to the requirements in the respective field of use.

Here the cover plate 3 has a wave-shaped curvature. This curvature serves for protection of the screws, not shown here, for attachment of the clearing strip 1 to the aforementioned clearing blade against wear (see, for example, DE 10 2006 021 910 A1).

It can be seen, in particular from FIGS. 2-4, that the base plate 2 and the cover plate 3 tightly seal the region above the hard-material elements 6 toward the outside, so that the rubber-elastic layer 5 could not escape penetration of the hard-material elements 6 if the buffer space 7 were not present. Thus the buffer space 7 opens up the movement paths upward, which are required when impacts from below occur, in each instance, for the hard-material elements 6. Therefore the hard-material elements can better move away upward without being subjected to excess stress.

REFERENCE SYMBOL LIST

1 clearing strip
1*a* length of the clearing strip
2 base plate
3 cover plate
4 bore
5 rubber-elastic layer
6 hard-material elements
7 buffer space
8 hose
9 foam rubber

The invention claimed is:

1. A clearing strip (1) for the clearing blade of a snowplow, which strip has, in a sandwich design, a steel base plate (2), a steel cover plate (3), and a rubber-elastic layer (5) that lies between them, having at least one embedded hard-material element (6), whereby the steel base plate (2) and the steel cover plate (3) tightly seal the region above the hard-material elements (6) toward the outside in such a way that the rubber-elastic layer (5) cannot move upwards when the at least one embedded hard-material element moves, wherein at least one resilient buffer space (7) is provided in the rubber-elastic layer (5) above the hard-material elements (6).

2. The clearing strip (1) according to claim 1, wherein the buffer space (7) runs in the rubber-elastic layer (5) parallel to the lower edge of the clearing strip (1) and extends over its entire length.

3. The clearing strip (1) according to claim 2, wherein the buffer space (7) has the same cross-sectional surface area over its entire length.

4. The clearing strip (1) according to claim 1, wherein the cross-sectional surface area of the buffer space (7) is rounded or at least rounded off at the corners.

5. The clearing strip (1) according to claim 2, wherein the cross-sectional surface area of the buffer space (7) is elliptical and wherein the longitudinal axis of the elliptical cross-sectional surface area runs parallel to the lower edge of the clearing strip (1).

6. The clearing strip (1) according to claim 2, wherein the cross-sectional surface area of the buffer space (7) is elliptical and wherein the longitudinal axis of the elliptical cross-sectional surface area runs perpendicular to the lower edge of the clearing strip (1).

7. The clearing strip (1) according to claim 2, wherein the buffer space (7) is filled with a foam material (9) or a foam rubber.

8. The clearing strip (1) according to claim 2, wherein the buffer space (7) is sheathed by a hose (8).

9. The clearing strip (1) according to claim 2, wherein the buffer space (7) of the clearing strip (1) is a cavity and is open for allowing a cooling medium to be passed through.

* * * * *